US011864645B2

(12) United States Patent
Storms, Jr. et al.

(10) Patent No.: US 11,864,645 B2
(45) Date of Patent: Jan. 9, 2024

(54) INTERLOCKING ATTACHMENT SYSTEMS

(71) Applicant: Sentry Solutions Products Group LLC, Virginia Beach, VA (US)

(72) Inventors: Frederick W. Storms, Jr., Virginia Beach, VA (US); Eric M. Yeates, Virginia Beach, VA (US)

(73) Assignee: Sentry Solutions Products Group LLC, Virginia Beach, VA (US)

( * ) Notice: Subject to any disclaimer, the term of this patent is extended or adjusted under 35 U.S.C. 154(b) by 252 days.

(21) Appl. No.: 17/508,027

(22) Filed: Oct. 22, 2021

(65) Prior Publication Data

US 2022/0117383 A1 Apr. 21, 2022

Related U.S. Application Data

(63) Continuation-in-part of application No. 17/439,934, filed as application No. PCT/US2020/035158 on May 29, 2020.

(60) Provisional application No. 62/853,947, filed on May 29, 2019.

(51) Int. Cl.
*A45F 5/00* (2006.01)

(52) U.S. Cl.
CPC ..... *A45F 5/00* (2013.01)

(58) Field of Classification Search
CPC ..... A45F 5/00; A45F 2200/00; A45F 5/02; A45C 2013/306; Y10T 24/1397
See application file for complete search history.

(56) References Cited

U.S. PATENT DOCUMENTS

| | | | | |
|---|---|---|---|---|
| 3,438,095 | A * | 4/1969 | Evans | B65D 63/10 24/16 PB |
| 6,192,554 | B1 * | 2/2001 | Dumcum | B65D 63/1018 24/30.5 P |
| 7,704,587 | B2 * | 4/2010 | Harsley | B65D 63/1018 428/134 |
| 8,523,029 | B2 * | 9/2013 | Rogers | F41C 33/045 224/675 |
| 11,530,897 | B2 * | 12/2022 | Smith | F41C 33/041 |
| 11,661,254 | B1 * | 5/2023 | Storms, Jr. | B65D 63/1027 24/712 |
| 11,684,141 | B1 * | 6/2023 | Storms, Jr. | A45F 5/00 24/712 |
| 2007/0178761 | A1 * | 8/2007 | Wemmer | A45F 5/02 439/596 |

* cited by examiner

*Primary Examiner* — Robert Sandy
(74) *Attorney, Agent, or Firm* — Shaddock Law Group, PC

(57) ABSTRACT

An interface portion having at least one locking aperture defined by a top wall and an opposing bottom wall and a pair of opposing, substantially equal length, parallel side walls, and wherein an upturned corner portion is defined between the top wall and each of the parallel side walls; and at least one attachment element extends from the interface portion, having attachment element notches formed in opposing side portions defining a neck portion, wherein the attachment element notches define barb portions, wherein at least a portion of the at least one attachment element is positionable through the locking aperture such that the neck portion is positionable within the locking aperture, and wherein if a withdrawing force is applied to the attachment element a portion of the barb portions engages a portion of at least one of the upturned corner portions to aid in resisting the withdrawing force.

20 Claims, 10 Drawing Sheets

INTERLOCKING ATTACHMENT SYSTEMS

CROSS-REFERENCE TO RELATED APPLICATIONS

This patent application is a Continuation-In-Part of U.S. patent application Ser. No. 17/439,934, filed Sep. 16, 2021, which is a 371 of PCT/US2020/035158 filed May 29, 2020, which claims priority to U.S. Patent Application Ser. No. 62/853,947 filed May 29, 2019, the disclosures of which are incorporated herein by reference in their entireties.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE PRESENT DISCLOSURE

1. Field of the Present Disclosure

The present disclosure relates generally to the field of modular attachment systems. More specifically, the present disclosure relates to interlocking attachment systems.

2. Description of Related Art

It is advantageous be able to configure and/or reconfigure various pouches, pockets, holsters, holders, and other accessories on items such as, for example, articles of clothing, vests, plate carriers, backpacks, packs, platforms, and other carriers.

It is generally known to removably attach such items using a MOLLE or other similar attachment system. The term MOLLE (Modular Lightweight Load-carrying Equipment) is used to generically describe load bearing systems and subsystems that utilize corresponding rows of interwoven webbing for modular pouch, pocket, and accessory attachment interface.

The MOLLE system is a modular system that incorporates the use of corresponding rows of webbing stitched onto a piece of equipment, such as a vest, and the various MOLLE compatible pouches, pockets, and accessories, each accessory having mating rows of stitched webbing. MOLLE compatible pouches, pockets, and accessories of various utility can then be attached or coupled wherever MOLLE webbing exists on the equipment.

The terms "MOLLE-compatible" or "MOLLE" system are not used to describe a specific system, but to generically describe accessory attachment interface systems that utilize interwoven PALS (Pouch Attachment Ladder System) webbing for modular accessory interface portions.

An exemplary MOLLE compatible carrier portion includes a plurality of substantially parallel rows of spaced apart, horizontal carrier webbing elements. Each of the carrier webbing elements is secured to a backing or carrier material, by vertical stitching, at spaced apart locations, such that a tunnel segment is formed between the carrier material and the carrier webbing elements between each secured location of the carrier webbing elements. Each of the tunnel segments is formed substantially perpendicular to a longitudinal axis or direction of the carrier webbing elements.

The MOLLE compatible carrier portion, or MOLLE system grid, typically consists of horizontal rows of 1 inch (2.5 cm) webbing, spaced 1 inch apart, and attached or coupled to the carrier material at 1.5 inch (3.8 cm) intervals.

An exemplary accessory includes a plurality of substantially parallel, spaced apart accessory webbing elements. The accessory webbing elements are spaced apart to correspond to the spaces between the spaced apart carrier webbing elements. The accessory webbing elements are secured to the accessory at spaced apart locations, such that an accessory tunnel segment is formed between the accessory and the accessory webbing element between each secured location of the accessory webbing element. Each of the accessory tunnel segments is formed substantially perpendicular to a longitudinal direction of the accessory webbing elements.

When the accessory is placed adjacent the carrier material such that the accessory webbing elements are within the spaces between the spaced apart carrier webbing elements (and the carrier webbing elements are within the spaces between the spaced apart accessory webbing elements) and corresponding tunnel segments and accessory tunnel segments are aligned, a strap or coupling element may be interwoven between the aligned tunnel segments and accessory tunnel segments (alternating between horizontal carrier webbing element portions on the host or carrier material and horizontal webbing portions on the accessory) to removably attach the accessory to the carrier material.

Thus, through the use of a MOLLE or MOLLE-type system, an accessory may be mounted to a variety of carrier materials. Likewise, if a particular carrier material includes a MOLLE compatible system, a variety of accessories may be interchangeably mounted to the platform to accommodate a variety of desired configurations.

MOLLE compatible systems allow, for example, various pouch arrangements to be specifically tailored to a desired configuration and then reconfigured, if desired. Various desired pouches, pockets, and accessories can be added and undesired or unnecessary pouches, pockets, or accessories can be removed.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE PRESENT DISCLOSURE

However, the typical "MOLLE-compatible" or "MOLLE" accessory has various shortcomings. For example, known "MOLLE-compatible" or "MOLLE" systems typically utilize strap or coupling elements that can be inadvertently or unintentionally withdrawn from an accessory or carrier material, when interwoven between the accessory and the carrier material.

In order to solve these and other shortcomings of known "MOLLE-compatible" other known accessories and/or other attachment interfaces and to provide certain advantages over known "MOLLE-compatible" and/or other attachment interfaces, the interlocking attachment systems of the present disclosure provides at least some of an interface portion, wherein a plurality of interface apertures are provided through at least a portion of the interface portion, wherein the interface apertures are aligned in at least one column, and wherein at least one locking aperture is provided through the interface portion, proximate a last of the aligned interface apertures, wherein the at least one locking aperture is defined by an opposing top wall and a bottom wall and a pair of opposing, substantially equal length, parallel side walls, and wherein an upturned corner portion is formed between the top wall and each of the parallel side walls; and at least one attachment element extending from a portion of the interface portion to a terminal end, wherein the interface portion and the at least one attachment element are formed as a unitary body, wherein attachment element notches are formed in opposing side portions of the at least one attachment element defining a neck portion of the attachment element, wherein the attachment element notches define barb portions that extend away from the terminal end of the attachment element, wherein at least a portion of the at least one attachment element is positionable through the at least one locking aperture such that the neck portion of the at least one attachment element is positionable within the locking aperture, and wherein if a withdrawing force is applied to the attachment element a portion of the barb portions engages a portion of at least one of the upturned corner portions.

In certain exemplary, nonlimiting embodiments, a distance between the parallel side walls defines a width of the locking aperture.

In certain exemplary, nonlimiting embodiments, a width of each locking aperture corresponds to a width of the neck of the attachment element between opposing attachment element notches (a width of the attachment element between opposing notch walls) of a given attachment element.

In certain exemplary, nonlimiting embodiments, each locking aperture is generally formed as a rectangular or rounded rectangular slot or aperture.

In certain exemplary, nonlimiting embodiments, each of the upturned corner portions extends away from the bottom wall.

In certain exemplary, nonlimiting embodiments, each of the upturned corner portions extends beyond at least a portion of the top wall to an apex.

In certain exemplary, nonlimiting embodiments, a flap portion is defined between the upturned corner portions.

In certain exemplary, nonlimiting embodiments, the attachment element notches comprise mirror image recesses.

In certain exemplary, nonlimiting embodiments, the neck portion has a reduced width, when compared to a width of other portions of the body portion.

In certain exemplary, nonlimiting embodiments, a width of the barb portion is substantially similar to a width of the body portion of the attachment element.

In certain exemplary, nonlimiting embodiments, the notch recess wall is formed substantially perpendicular to a longitudinal axis of the attachment element.

In certain exemplary, nonlimiting embodiments, each of the attachment element notches is defined by a notch recess wall that extends into a portion of the body portion, a notch wall that extends from the notch recess wall to a notch apex, and a barb shoulder wall that extends from the notch apex to a barb apex.

In certain exemplary, nonlimiting embodiments, each barb portion extends from the notch apex, along the barb shoulder wall, to the barb apex of each attachment element notch, away from the terminal end of the attachment element.

In certain exemplary, nonlimiting embodiments, the barb shoulder wall is formed at an acute angle relative to a longitudinal axis of the attachment element.

In certain exemplary, nonlimiting embodiments, the barb shoulder wall is formed at an obtuse angle relative to a longitudinal axis of the attachment element.

In certain exemplary, nonlimiting embodiments, if a withdrawing force is applied to the attachment element a portion of the barb portions engages a portion of at least one of the upturned corner portions to resist the withdrawing force.

In certain exemplary, nonlimiting embodiments, the interlocking attachment systems of the present disclosure includes two or more attachment elements extending from the interface portion and a corresponding column of interface apertures and at least one locking aperture for each attachment element.

In various exemplary, non-limiting embodiments, the interlocking attachment systems of the present disclosure provides at least some of an interface portion having at least one locking aperture formed therethrough, wherein the interface apertures are aligned in at least one column, and wherein at least one locking aperture is provided through the interface portion, proximate a last of the aligned interface apertures, wherein the at least one locking aperture is defined by a top wall and an opposing bottom wall and a pair of opposing, substantially equal length, parallel side walls, and wherein an upturned corner portion is defined between the top wall and each of the parallel side walls; and at least one attachment element extending from a portion of the interface portion to a terminal end, wherein the interface portion and the at least one attachment element are formed as a one-piece article, wherein attachment element notches are formed in opposing side portions of the at least one attachment element defining a neck portion of the attachment element, wherein the attachment element notches define barb portions that extend away from the terminal end of the attachment element to a barb apex, wherein at least a portion of the at least one attachment element is positionable through the at least one locking aperture such that the neck portion of the at least one attachment element is positionable within the locking aperture, and wherein if a withdrawing force is applied to the attachment element a portion of the barb portions engages a portion of at least one of the upturned corner portions to aid in resisting the withdrawing force.

In certain exemplary, nonlimiting embodiments, each of the attachment element notches is defined by a notch recess wall that extends into a portion of the body portion, a notch wall that extends from the notch recess wall to a notch apex, and a barb shoulder wall that extends from the notch apex to the barb apex.

In various exemplary, non-limiting embodiments, the interlocking attachment systems of the present disclosure provides at least some of an interface portion having at least one locking aperture formed therethrough, defined by a top wall and an opposing bottom wall and a pair of opposing, substantially equal length, parallel side walls, and wherein an upturned corner portion is defined between the top wall and each of the parallel side walls; and at least one attachment element extending from a portion of the interface portion to a terminal end, wherein attachment element notches are formed in opposing side portions of the at least one attachment element defining a neck portion of the attachment element, wherein the attachment element notches define barb portions that extend away from the terminal end of the attachment element to a barb apex, wherein at least a portion of the at least one attachment element is positionable through the at least one locking aperture such that the neck portion of the at least one attachment element is positionable within the locking aperture, and wherein if a withdrawing force is applied to the attachment element a portion of the barb portions engages a portion of at least one of the upturned corner portions to aid in resisting the withdrawing force.

Accordingly, the present disclosure separately and optionally provides an interlocking attachment systems that allows a user to readily attach an accessory to at least a portion of a carrier or carrier material.

The present disclosure separately and optionally provides an attachment element having barb portions that engage upturned corner portions of a locking aperture when a withdrawing force is applied to withdraw or remove the attachment element from the locking aperture.

The present disclosure separately and optionally provides an interlocking attachment systems that is able to resist a withdrawing force of an attachment element from a locking aperture.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures.

While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the present disclosure that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF EXEMPLARY EMBODIMENTS OF THE PRESENT DISCLOSURE

Figure 1:
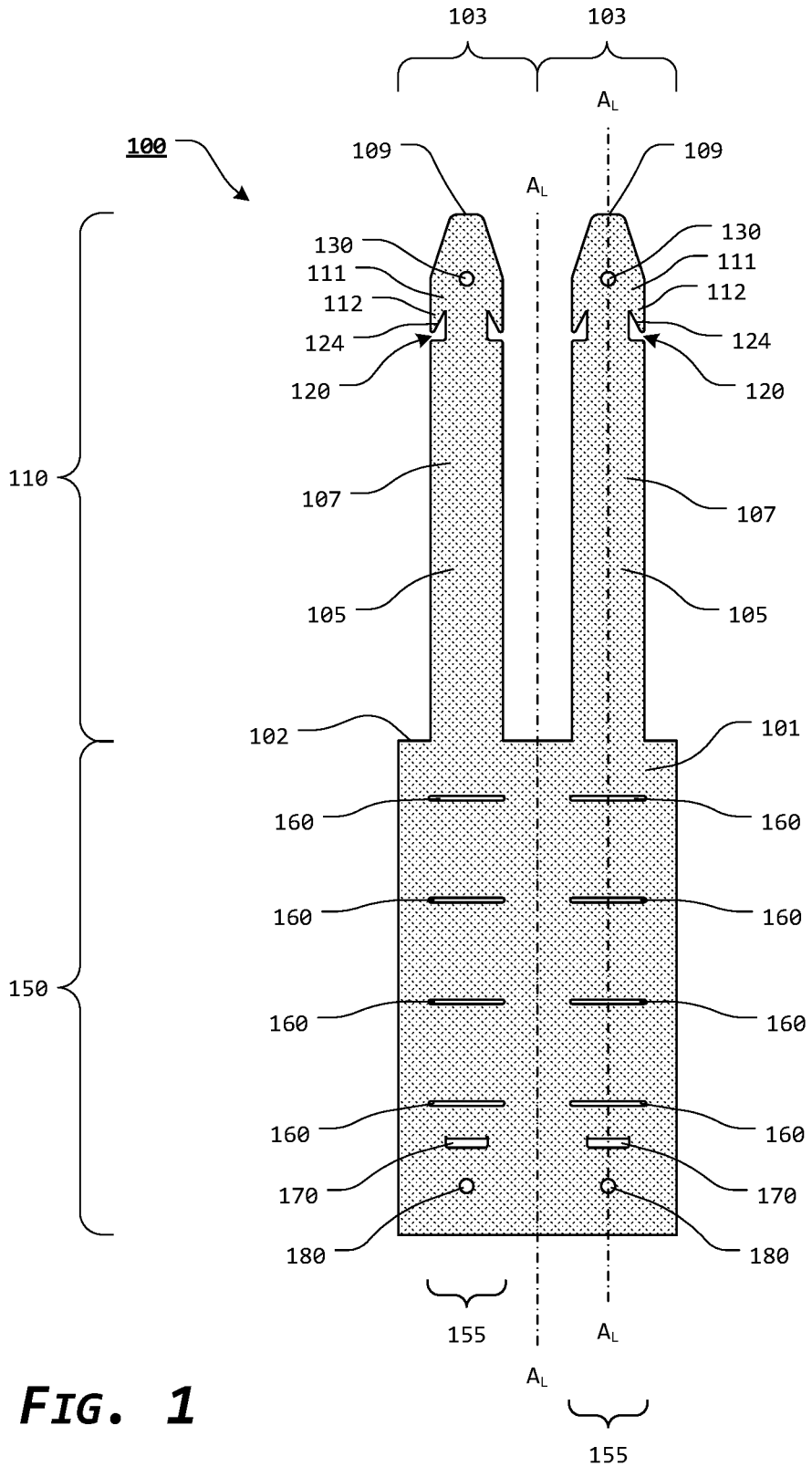
FIG. 1 illustrates a front view of an exemplary embodiment of an optional interlocking attachment system, according to the present disclosure.
Figure 2:
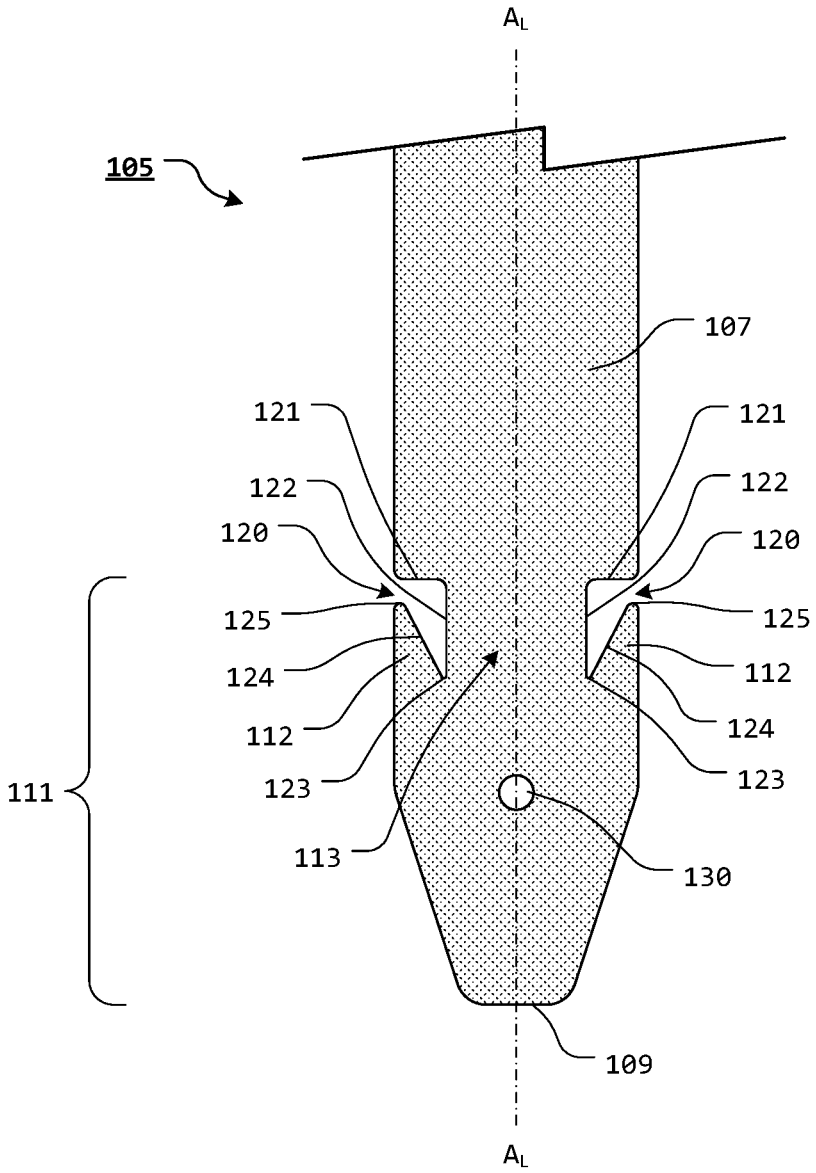
FIG. 2 illustrates a more detailed, front view of a portion of an exemplary embodiment of an attachment element of an interlocking attachment systems, according to the present disclosure.

For simplicity and clarification, the design factors and operating principles of the interlocking attachment systems according to the present disclosure are explained with reference to various exemplary embodiments of an interlocking attachment systems according to the present disclosure. The basic explanation of the design factors and operating principles of the interlocking attachment systems is applicable for the understanding, design, and operation of the interlocking attachment systems of the present disclosure. It should be appreciated that the interlocking attachment systems can be adapted to many applications where an interlocking attachment systems can be used.

As used herein, the word "may" is meant to convey a permissive sense (i.e., meaning "having the potential to"), rather than a mandatory sense (i.e., meaning "must"). Unless stated otherwise, terms such as "first" and "second", "right" and "left", "top" and "bottom", "upper" and "lower", and "horizontal" and "vertical" are used to arbitrarily distinguish between the exemplary embodiments, elements, and/or element portions such terms describe. Thus, these terms are not necessarily intended to indicate temporal or other prioritization of such exemplary embodiments and/or elements.

As used herein, and unless the context dictates otherwise, the term "coupled" is intended to include both direct coupling (in which two elements that are coupled to each other contact each other) and indirect coupling (in which at least one additional element is located between the two elements). The term coupled, as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

Furthermore, the terms "front", "rear", "right", "left", "upper", and "lower", as used in reference to the attachment interface and the interface portion, are used for basic explanation and understanding of the operation of the presently disclosed systems, methods, and/or apparatuses and are to be seen as a naming convention used to help differentiate between certain of the components of the present disclosure and are not to be construed as limiting the systems, methods, and/or apparatuses of the present disclosure.

It should also be appreciated that the terms "interlocking attachment systems", "attachment element", "interface aperture", "locking aperture", and "accessory" are used for basic explanation and understanding of the operation of the systems, methods, and apparatuses of the present disclosure. Therefore, the terms "interlocking attachment systems", "attachment element", "interface aperture", "locking aperture", and "accessory" are not to be construed as limiting the systems, methods, and apparatuses of the present disclosure.

For simplicity and clarification, the interlocking attachment systems 100 of the present disclosure will be shown and/or described as being used in conjunction with an exemplary accessory 190 pouch being utilized as an exemplary accessory 190. However, it should be appreciated that these are merely exemplary embodiments of the interlocking attachment systems 100 and are not to be construed as limiting the present disclosure. Thus, the interlocking attachment systems 100 of the present disclosure may be utilized in conjunction with any portion of a pouch, carrier, object, or device.

Turning now to the appended drawing figures, FIGS. 1-12 illustrate certain elements and/or aspects of various exemplary embodiments and aspects of an interlocking attachment system 100, according to certain exemplary embodiments of the present disclosure.

In certain illustrative, non-limiting embodiment(s) of the presently disclosed systems, methods, and/or apparatuses, as illustrated in FIGS. 1-12, the interlocking attachment system 100 comprises at least one interlocking attachment portion 103 having a front side 101 and an opposing rear side 102. Each interlocking attachment portion 103 includes an interface portion 150 and an attachment portion 110 formed as integral components of each interlocking attachment portion 103. In various illustrative, non-limiting embodiment(s), as illustrated in FIGS. 1 and 9-11, the interlocking attachment system 100 includes adjacent interlocking attachment portions 103 formed as a monolithic, integrally formed portion of the interlocking attachment system 100, such that the interlocking attachment system 100, including the interlocking attachment portions 103, is formed of a unitary body or a one-piece article.

One or more attachment elements 105 extend as an integral extension of a portion of the interface portion 150 to form the attachment portion 110. In various illustrative, non-limiting embodiment(s), the attachment elements 105 are formed as a monolithic, integrally formed portion of the interface portion 150, such that the interface portion 150, including the attachment elements 105, is formed of a unitary body or a one-piece article.

Each attachment element 105 includes a body portion 107 that extends from the interface portion 150. The body portion 107 extends to a head portion 111 having a terminal end 109. Each body portion 107 generally extends parallel to a longitudinal axis, $A_L$, of the interlocking attachment system 100. Thus, instead of being formed of a separate material or separate portion of material that is attached or coupled to the interface portion 150, each attachment element 105 extends as a continuation of the material used to form the interface portion 150 of the interlocking attachment system 100.

It should be appreciated that the interlocking attachment system 100 may be formed to include a single attachment element 105 extending from the interface portion 150 and including a single column 155 of interface apertures 160 and at least one locking aperture 170 and optional interface locking aperture 180, each aligned along the longitudinal axis, $A_L$, of the interlocking attachment system 100. Alternatively, the interlocking attachment system 100 may include two or more attachment elements 105 extending from the interface portion 150 and a corresponding column 155 of interface apertures 160 and at least one locking aperture 170 and optional interface locking aperture 180 for each attachment element 105.

Attachment element notches 120 comprise mirror image recesses formed in opposing side portions of each attachment element 105, within the head portion 111, proximate the terminal end 109 of each attachment element 105. The attachment element notches 120 define a neck portion 113 of the attachment element 105 with a reduced width, when compared to a width of other portions of the body portion 107.

Each attachment element notch 120 is formed proximate each respective terminal end 109 and is defined by a notch recess wall 121 that extends into a portion of the body portion 107, a notch wall 122 that extends from the notch recess wall 121 to a notch apex 123, and a barb shoulder wall 124 that extends from the notch apex 123 to a barb apex 125.

In various exemplary embodiments, the notch recess wall 121 is optionally formed substantially perpendicular to a longitudinal axis, $A_L$, of the attachment element 105. The barb shoulder wall 124 is optionally formed at an acute or obtuse angle relative to the longitudinal axis, $A_L$, of the attachment element 105. In these exemplary embodiments, the angle of the barb shoulder wall 124 allows the terminal end 109 to be more firmly held within a locking aperture 170.

A barb portion 112 extends from the notch apex 123, along the barb shoulder wall 124, to the barb apex 125 of each attachment element notch 120, away from the terminal end 109 of the attachment element 105, within the terminal end 109 of the attachment element 105. In various exemplary embodiments, a width of the barb portion 112, proximate the barb shoulder wall 124, is the same or substantially the same as the width of the body portion 107 of the attachment element 105. The width of the head portion 111 may optionally taper towards a center of the body portion 107 as the head portion 111 extends from the barb portion 112 toward the terminal end 109.

An interlocking attachment aperture 130 may optionally be formed through a portion of the attachment element 105, proximate the terminal end 109. If included, the interlocking attachment aperture 130 may be utilized to further assist in securing the attachment element 105 to the interface portion 150 by allowing a portion of material to be positioned through the interlocking attachment aperture 130 and the interface locking aperture 180 of the interface portion 150.

The interface portion 150 is formed to include a plurality of spaced apart interface apertures 160 formed therethrough. In various exemplary embodiments, the interface apertures 160 are generally formed as slots or apertures through the interface portion 150. Each interface aperture 160 is defined by one or more continuous edges. In various exemplary embodiments, each interface aperture 160 is generally formed as a rectangular or rounded rectangular slot or aperture.

The interface portion 150 of the present disclosure is operable with as few as two interface apertures 160. Thus, the size and shape of the interface portion 150 is a design choice, based upon, for example, the size and shape of the portion of interface portion 150 that is desired to potentially accept attachment or coupling of attachment elements 105.

In various exemplary embodiments, the size of each interface aperture 160 is influenced or dictated by the width of the attachment elements 105. For example, if an attachment element 105 has a width of approximately 1 inch, the width of the interface apertures 160 may optionally be slightly greater than approximately 1 inch, to allow the attachment elements 105 to be appropriately positioned through the interface apertures 160. It should be appreciated that the size and shape of each of the interface apertures 160 is a design choice based upon the desired functionality and/or appearance of the interface portion 150 and the ability of each interface aperture 160 to allow at least a portion of an attachment element 105 to pass therethrough without undue or excess movement or play within each interface aperture 160.

The interface apertures 160 are arranged in a repeating or semi-repeating series or sequence of spaced apart, repeating patterns. In various exemplary embodiments, the interface apertures 160 are arranged in a column 155. The longitudinal axis, $A_L$, of the column 155 is parallel to the longitudinal axis, $A_L$, of each attachment element 105.

It should be appreciated that two or more adjacent interface apertures 160 may comprise a row and two or more adjacent interface apertures 160 may comprise a column 155. Thus, it should be appreciated that the number of interface apertures 160 formed in the interface portion 150 is a design choice based upon the desired size and/or functionality of the interface portion 150.

By arranging the interface apertures 160 in a repeating or semi-repeating series or sequence, tunnel segments are created between adjacent interface apertures 160 (typically along a longitudinal axis, $A_L$, of a column 155).

One or more locking apertures 170 are also formed within the column 155 of interface apertures 160. The locking aperture 170 is typically formed between a last of the interface apertures 160 and the interface locking aperture 180, within a given column 155, and proximate a location where the attachment element notches 120 will be located when the attachment element 105 is folded over the interlocking attachment system 100.

In certain exemplary embodiments, an interface locking aperture 180 is formed proximate each locking aperture 170. Each interface locking aperture 180 is formed proximate a location where each interlocking attachment aperture 130 will rest when the attachment element notches 120 are positioned within the locking apertures 170. Alignment of the interface locking aperture 180 with the interlocking attachment aperture 130 allows an additional fastening element to be positioned through the aligned interlocking attachment aperture 130 and interface locking aperture 180 to further secure the head portion 111 of the attachment element 105 to the interface portion 150.

Figure 3:
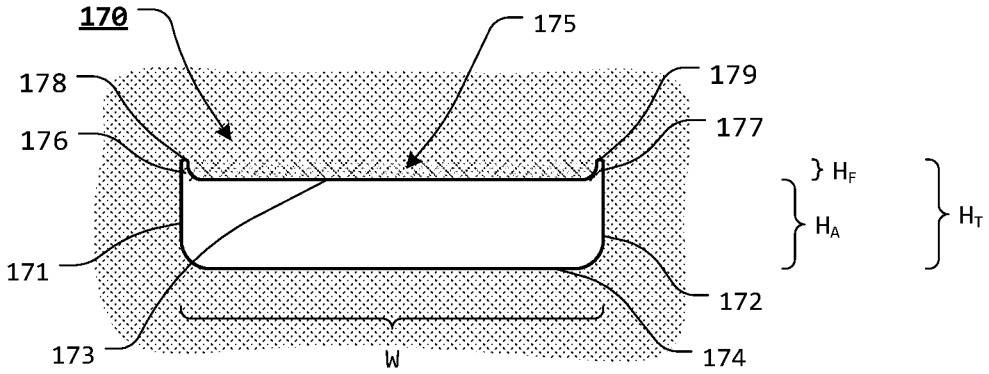
FIG. 3 illustrates a more detailed, front view of a portion of an exemplary embodiment of a locking aperture of an interface portion, according to the present disclosure.

In various exemplary embodiments, as illustrated, for example, in FIG. 3, each locking aperture 170 is a slot or aperture formed through the interface portion 150. Each locking aperture 170 may optionally be defined by one or more continuous edges or edge portions and is defined by an opposing top wall 173 and a bottom wall 174 and a pair of opposing, substantially equal length, parallel side walls 171 and 172. A distance between the parallel side walls 171 and 172 forms the width, W, of the locking aperture 170. In various exemplary embodiments, each locking aperture 170 is generally formed as a rectangular or rounded rectangular slot or aperture.

An upturned corner portion 176 or 177 is formed between the top wall 173 and an adjacent parallel side wall 171 or 172, respectively. Each upturned corner portion 176 and 177 extends upward, away from the bottom wall 174, from a portion of one of the parallel side walls 171 and 172, beyond at least a portion of the top wall 173 to a highest or furthest extent, or apex 178 or 179, respectively, of each of the upturned corner portions 176 and 177. The portion of the interface portion 150 that extends between the top wall 173 and the apex 178 or 179, respectively, of each of the upturned corner portions 176 and 177 from the bottom wall 174, forms a flap portion 175.

Thus, each locking aperture 170 has a total height, $H_T$, which extends from the bottom wall 174 to the apex 178 or 179, respectively, of each of the upturned corner portions 176 and 177. An aperture height, $H_A$, extends from the bottom wall 174 to the top wall 173 and a flap height, $H_F$, extends from the top wall 173 to the apex 178 or 179, respectively, of each of the upturned corner portions 176 and 177. Thus, the total height, $H_T$, is equal to the aperture height, $H_A$, plus the flap height, $H_F$.

The overall size of each locking aperture 170 is a design choice. It should be appreciated that the width, W, between of each of the parallel side walls 171 and 172 is a design choice based upon the desired functionality and/or appearance of the locking aperture 170. However, the width, W, of each locking aperture 170 generally corresponds to a width of a neck portion 113 of the attachment element 105 between opposing attachment element notches 120 (a width of the attachment element 105 between opposing notch walls 122) of a given attachment element 105.

Figure 4:
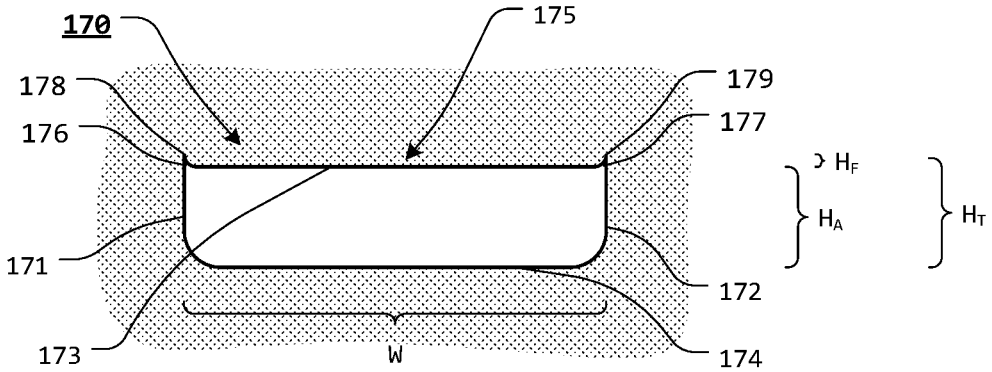
FIG. 4 illustrates a more detailed, front view of a portion of an exemplary embodiment of a locking aperture of an interface portion, according to the present disclosure.
Figure 5:
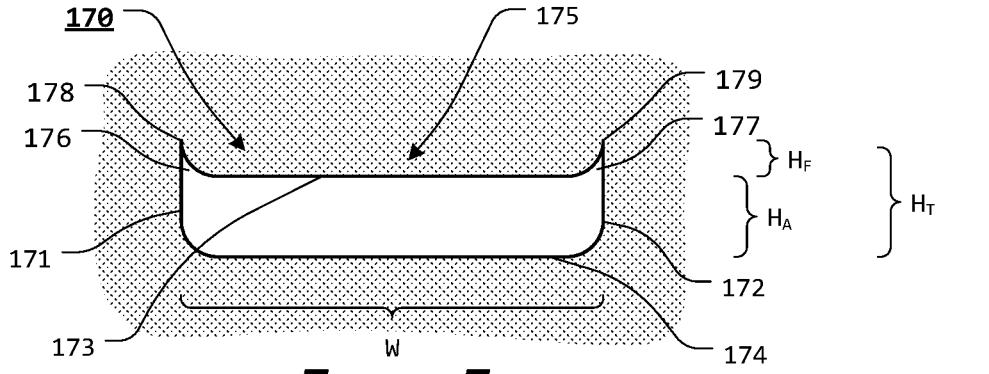
FIG. 5 illustrates a more detailed, front view of a portion of an exemplary embodiment of a locking aperture of an interface portion, according to the present disclosure.
Figure 6:
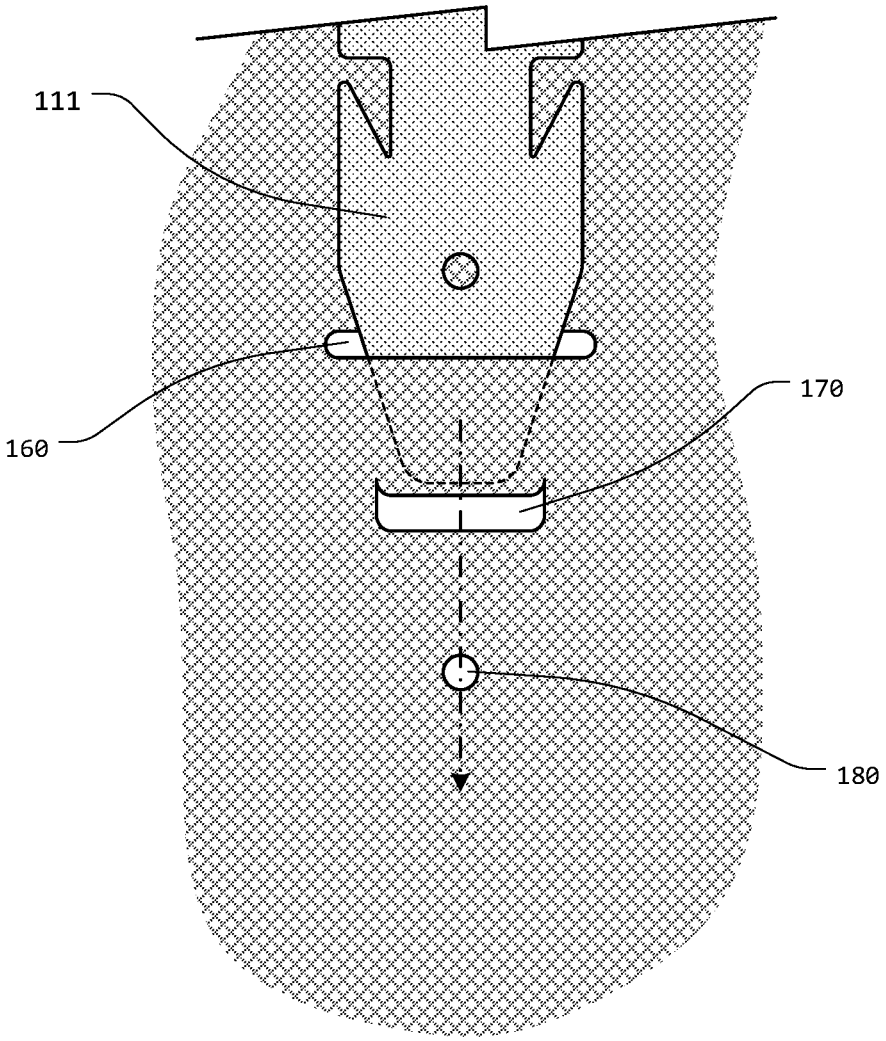
FIG. 6 illustrates a more detailed, front view of a portion of an exemplary embodiment of an interface portion, wherein a portion of the head portion of the attachment element is urged through an interface aperture of the interface portion, according to the present disclosure.
Figure 7:
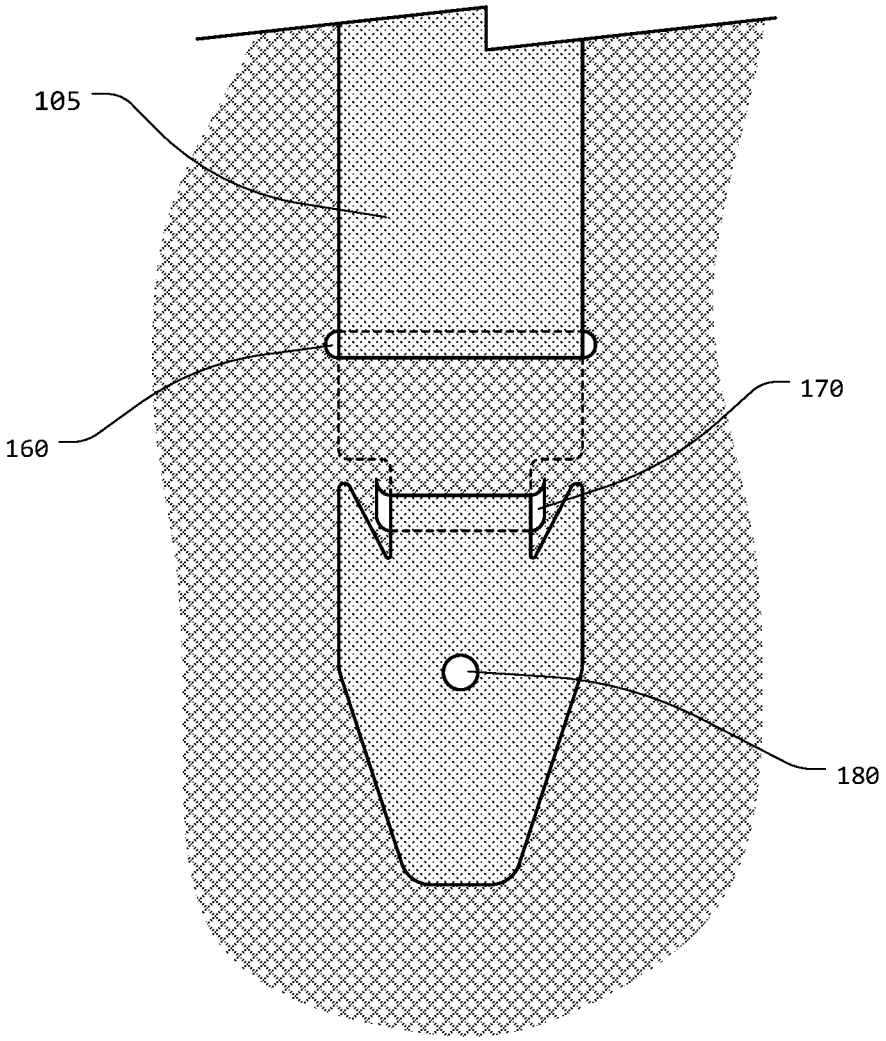
FIG. 7 illustrates a more detailed, front view of a portion of an exemplary embodiment of an interface portion, wherein a portion of the attachment element is urged through an interface aperture and a locking aperture of the interface portion, according to the present disclosure.

As illustrated in FIGS. 4 and 5, the flap height, $H_F$, may be altered to create a relatively larger or relatively smaller flap portion 175. Thus, the flap height, $H_F$, is a design choice based upon the desired overall size and/or shape of upturned corner portions 176 and 177.

While the locking aperture 170 is illustrated as comprising a somewhat rectangular aperture, it should be appreciated that the overall size and shape of the locking aperture 170 is a design choice based upon the desired appearance and/or functionality of the interlocking attachment system 100 and/or the size and/or shape of the attachment elements 105 with which the locking aperture 170 is to be utilized.

In certain exemplary embodiments, the material used to form the interlocking attachment system 100 is a portion of a fabric-type or other material, such as, for example, chlorosulfonated polyethylene (CSPE) synthetic rubber (CSM). In certain exemplary embodiments, the interlocking attachment system 100 is formed of a portion of Hypalon fabric. However, the present disclosure is not so limited. For example, in certain exemplary embodiments, the interlocking attachment system 100 may be formed of a rigid material, a semi-rigid material, or a substantially flexible material.

In various exemplary, non-limiting embodiments, all or portions of the interlocking attachment system 100 may be made of any fabric or other material, such as, for example, interwoven fabrics, canvas, acrylics, sheet fabrics, films, nylon, spandex, vinyl, Polyvinyl Chloride (PVC), neoprene, or the like. Alternatively, all or portions of the interlocking attachment system 100 may be formed from multiple, similar or dissimilar materials. In various exemplary, non-limiting embodiments, the interlocking attachment system 100 may be water-resistant or may include a cushion material.

It should be appreciated that the terms fabric and material are to be given their broadest meanings and that the particular fabric(s) or material(s) used to form the interlocking attachment system 100 is a design choice based on the desired appearance and/or functionality of the interlocking attachment system 100. In general, the material used to form the interlocking attachment system 100 is selected for its ability to allow the attachment elements 105 to be appropriately interwoven between the interface apertures 160 and/or the locking apertures 170 of the interface portion 150.

While the interface portion 150 is illustrated as comprising a somewhat rectangular portion of material, it should be appreciated that the overall size and shape of the interface portion 150 is a design choice based upon the desired appearance and/or functionality of the interlocking attachment system 100 and/or the size and/or shape of the accessory to which the interlocking attachment system 100 is to be attached or coupled.

Portions of the attachment elements 105 may be interwoven between portions of an item or surface and the interface apertures 160 to attach or couple the interface portion 150 to the desired item or surface.

Initially, each attachment element 105 extending from the interface portion 150 is aligned with an appropriate interface aperture 160. The terminal end 109 of each attachment element 105 is initially urged through an attachment slot or portion associated with an item or surface, into a tunnel segment of the item or service, and out of a subsequent attachment slot or portion associated with the item or service. The interweaving of the terminal end 109 of the attachment element 105 continues through subsequent interface apertures 160 and attachment slots are portions associated with the item or surface until the terminal end 109 of the attachment element 105 is positioned proximate a locking aperture 170 of the interface portion 150 (as illustrated, for example, in FIG. 6, wherein the attachment element 105 is shown interwoven without attachment to an item or surface).

It is believed that a more detailed description of how the attachment elements 105 are interwoven between portions of the item or surface and the interface apertures 160 is not required and that the level of description provided herein for interweaving the attachment element(s) 105 between portions of an item or surface and the interface apertures 160 is sufficient to enable one of ordinary skill in the art to understand and practice the systems, methods, and apparatuses, as described.

Once an attachment element 105 is appropriately interwoven between portions of an item or surface and the interface apertures 160, the attachment element notch 120 can be utilized in conjunction with a locking aperture 170 to further secure the head portion 111 of the attachment element 105 to the interface portion 150. As illustrated most clearly in FIGS. 6-8, the terminal end 109 is urged through the locking aperture 170 and the barb portions 112 of the attachment element 105 are folded or manipulated to be urged through the locking aperture 170. Once the barb portions 112 or barb shoulder walls 124 of the attachment element notches 120 exit the locking aperture 170, the barb shoulder walls 124 interact with the locking aperture 170 to provide resistance to a withdrawing force of the attachment element 105 from the locking aperture 170.

Figure 8:
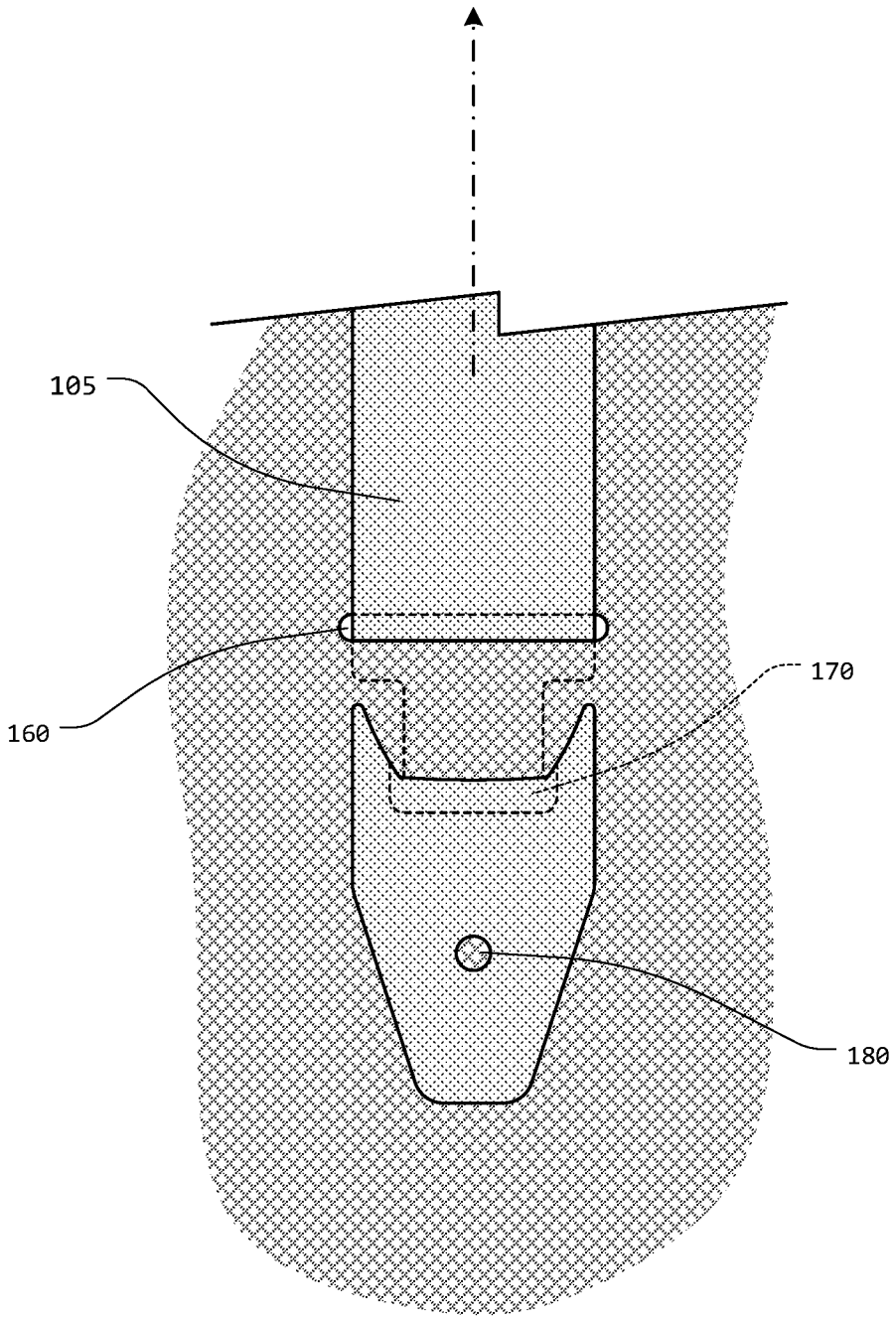
FIG. 8 illustrates a more detailed, front view of a portion of an exemplary embodiment of an interface portion, wherein a portion of the attachment element is urged through an interface aperture and a locking aperture of the interface portion, according to the present disclosure.
Figure 9:
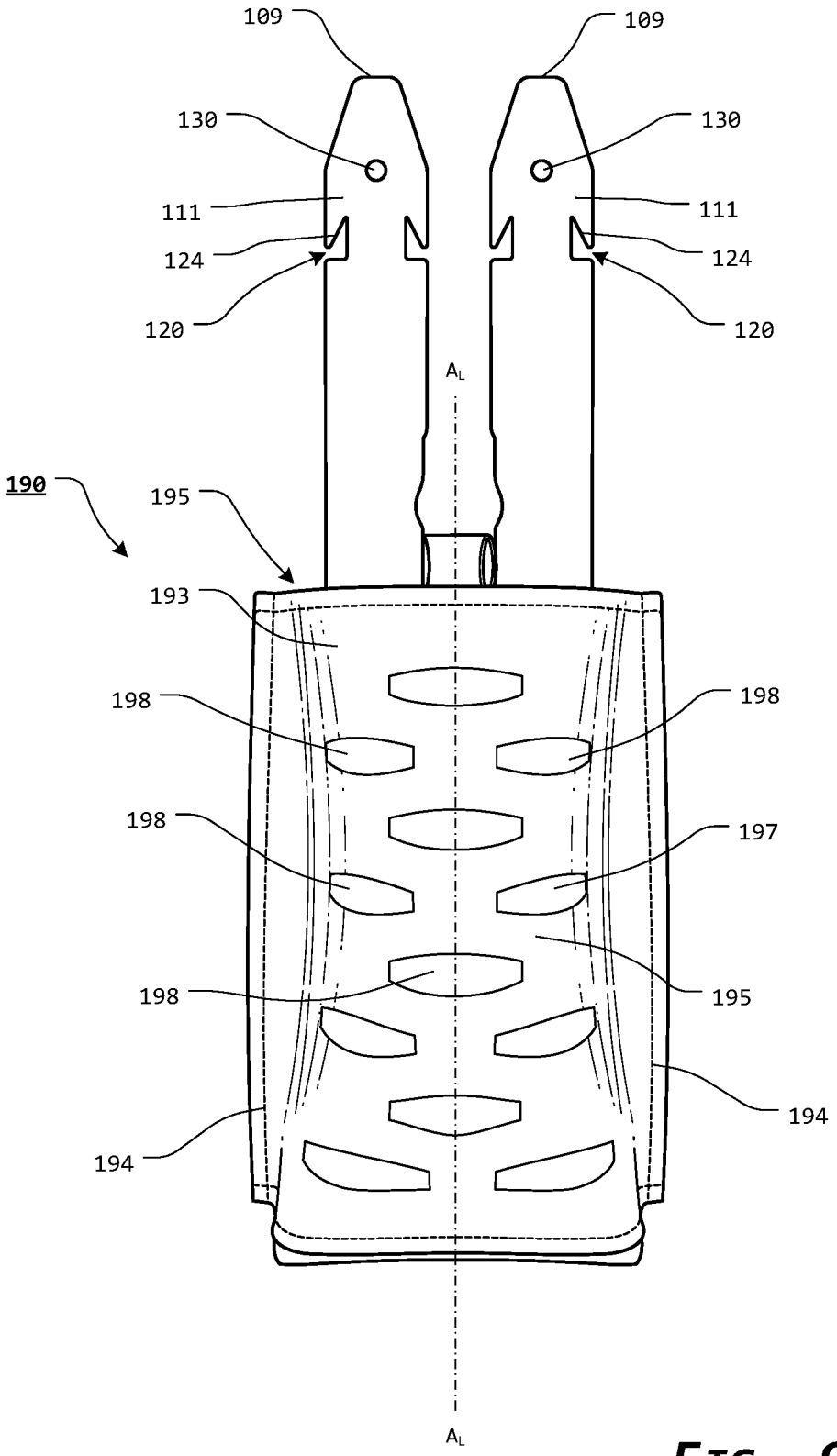
FIG. 9 illustrates a front view of an exemplary embodiment of an optional interlocking attachment system attached or coupled to an exemplary accessory, according to the present disclosure.
Figure 10:
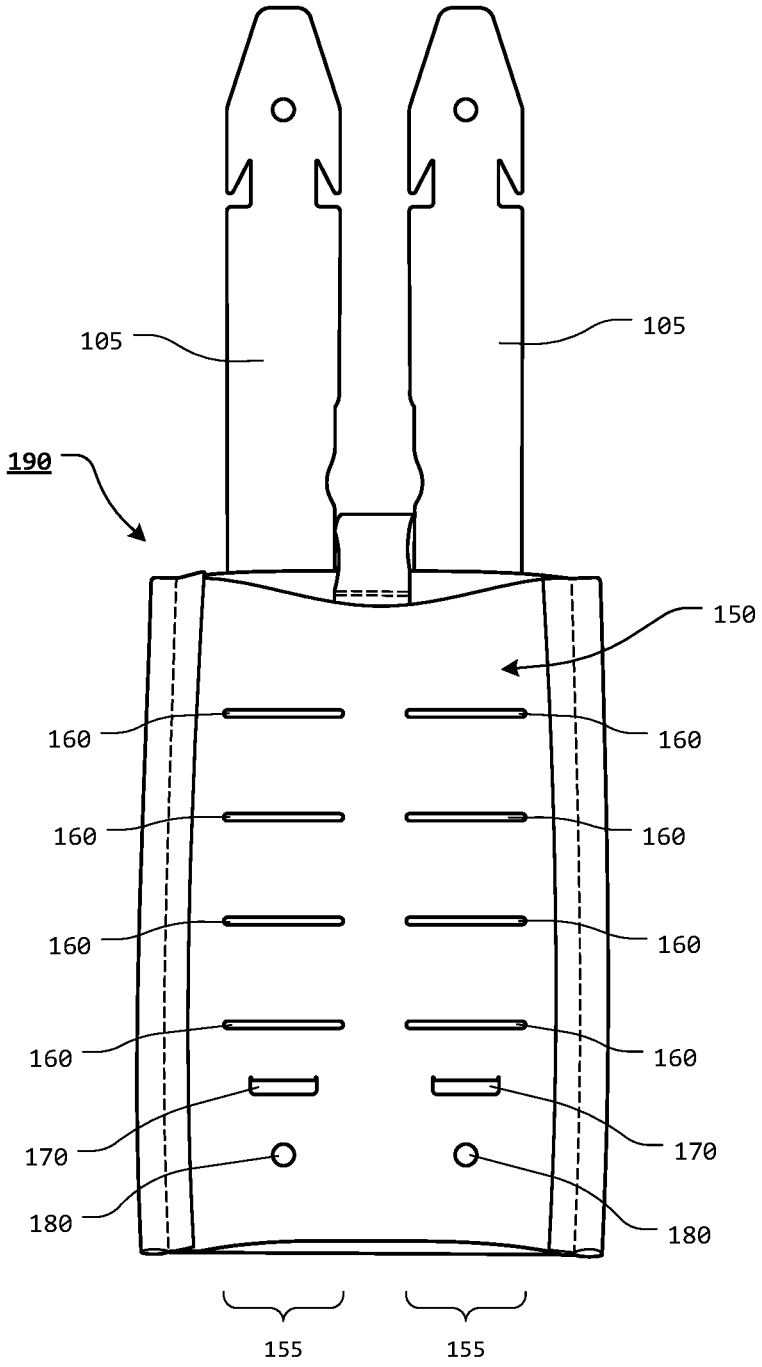
FIG. 10 illustrates a rear view of an exemplary embodiment of an optional interlocking attachment system attached or coupled to an exemplary accessory, according to the present disclosure.
Figure 11:
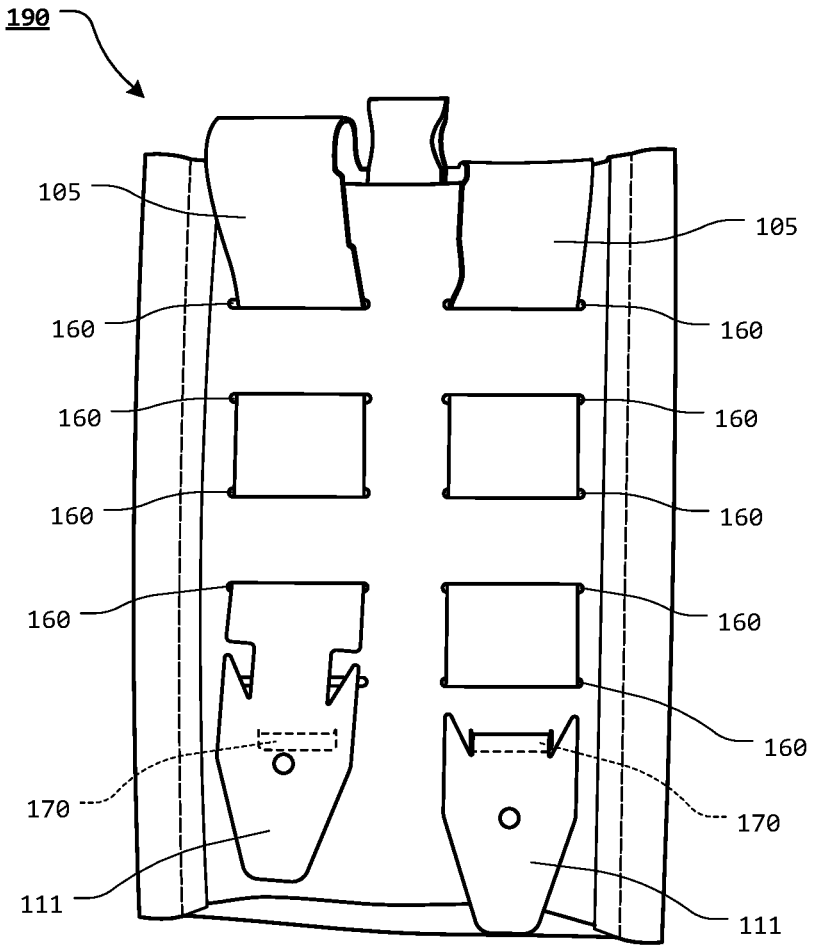
FIG. 11 illustrates a rear view of an exemplary embodiment of an optional interlocking attachment system attached or coupled to an exemplary accessory, wherein at least a portion of the attachment elements are urged through respective interface apertures and a locking aperture of the interface portion, according to the present disclosure.

If, as illustrated in FIG. 8, a withdrawing force is applied to the attachment element 105, the barb portions 112 engage the locking aperture 170 and portions of the barb portions 112 are drawn into the upturned corner portions 176 and 177 until the notch apexes 123 are urged to abut the apexes 178 and 179 and the flap portion 175 interacts with a portion of the attachment element 105 to further secure or lock the attachment element 105 within the locking aperture 170.

In this further secured or locked arrangement, the barb portions 112 act as barbs to engage the upturned corner portions 176 and 177. Because of the interaction between the barb shoulder walls 124 and the upturned corner portions 176 and 177, the attachment element 105 is able to resist a greater withdrawing force than if the barb shoulder walls 124 and the upturned corner portions 176 and 177 were not present.

Figure 12:
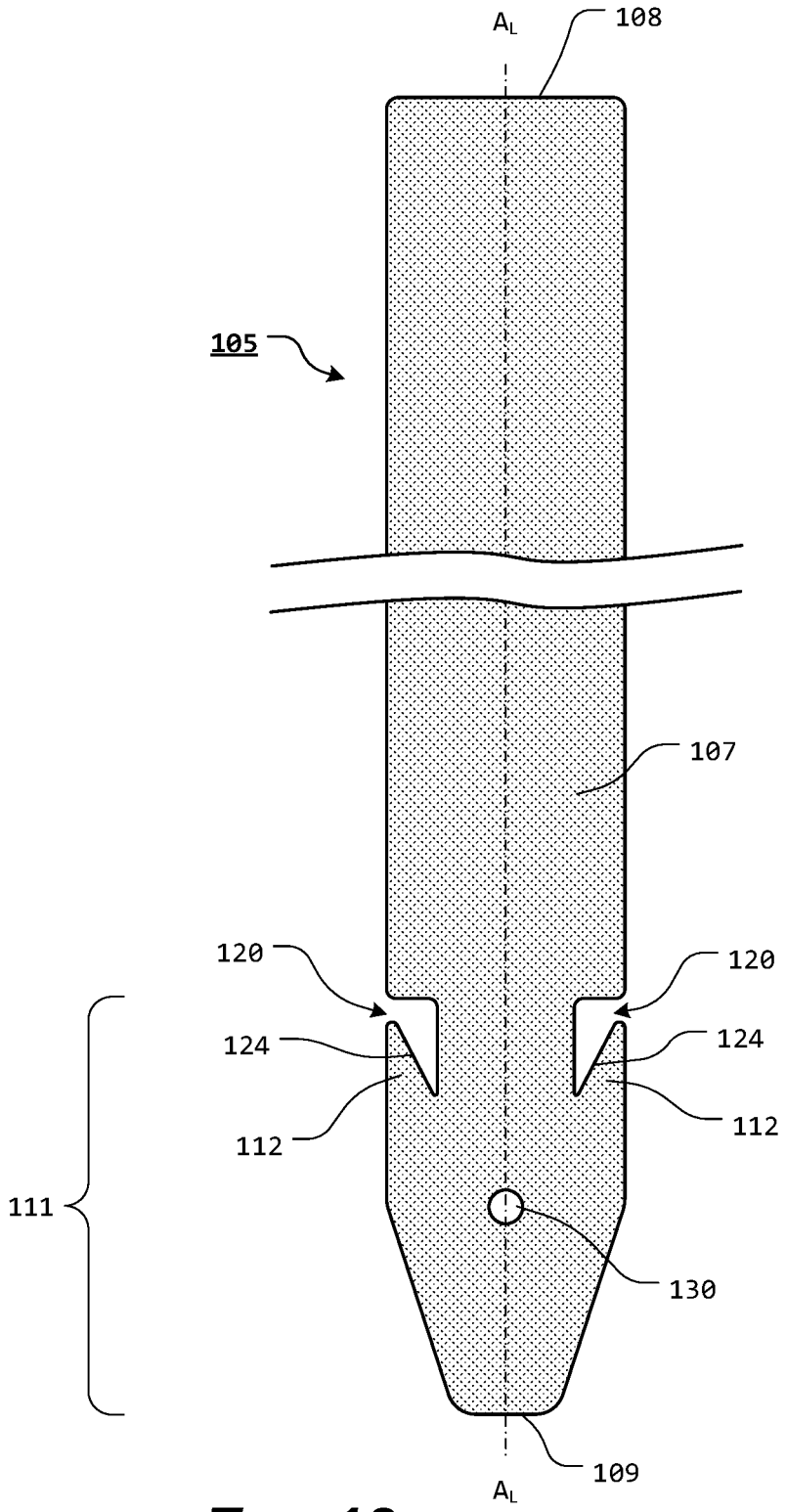
FIG. 12 illustrates a front view of an exemplary embodiment of an attachment element, according to the present disclosure.

As illustrated in FIG. 12, the attachment element 105 may optionally comprise a standalone component or element. In these exemplary embodiments, the attachment element 105 extends from an initiating 108 to the terminal end 109.

The interlocking attachment system 100 may be at least partially attached or coupled to a portion of an accessory 190. As illustrated most clearly in FIGS. 9-11, the interface portion 150 may optionally be attached or coupled to a portion of an accessory 190 by connection elements 194, such as stitching proximate a perimeter of the interface portion 150 and a perimeter of the portion of the accessory 190.

In certain exemplary embodiments, the connection elements 194 comprise stitching. Alternatively, the interface portion 150 may be attached or coupled to the accessory 190 via adhesive bonding, welding, screws, rivets, pins, mating hook and loop portions, snap or releasable fasteners, or other known or later developed means or methods for permanently or releasably attaching or coupling the interface portion 150 to the accessory 190.

In addition to the variability of size and shape of the interface portion 150, the orientation of the interface portion 150, relative to the accessory 190, is also a design choice. Thus, while the interface portion 150 is illustrated as being attached or coupled to the accessory 190, such that the columns 155 of interface apertures 160 are substantially parallel to the longitudinal axis, $A_L$, along the length, of the accessory 190, it should be appreciated that this is merely exemplary and the interface portion 150 may be attached at any desired angular or rotational orientation relative to the accessory 190.

The portions of material of the interface portion 150 between adjacent interface apertures 160 form tunnel segments. If the interface portion 150 is attached to an accessory 190, the tunnel segments are formed between the interface portion 150 and the surface of the accessory 190. The tunnel segments provide areas for securing the attachment elements 105 to the interface portion 150. In this manner, an attachment element 105 may be interwoven between the aligned tunnel segments to removably attach the accessory 190 to a portion of MOLLE webbing, slots, or other features of an article of clothing, a vest, a plate carrier, a backpack, a pack, a platform, and other carrier or device to which the accessory 190 is to be attached.

A more detailed explanation of the instructions regarding how to interweave the attachment element 105 between the interface apertures 160 and attachment elements of the device to which the accessory 190 is to be attached or coupled is not provided herein because accessories incorporating the interlocking attachment system 100 of the present disclosure are generally attached or coupled to the device to which the accessory 190 is to be attached or coupled in a manner similar to the manner in which accessories are attached or coupled to a portion of MOLLE webbing. Therefore, it is believed that the level of description provided herein is sufficient to enable one of ordinary skill in the art to understand and practice the systems, methods, and apparatuses, as described.

It should be appreciated that while the interlocking attachment system 100 is optionally described as being a separate element that is attached or coupled to a rear portion of an accessory 190, the interlocking attachment system 100 is not so limited. For example, the interlocking attachment system 100 may comprise an integral portion of an accessory 190, which forms an outer rear portion or outer rear wall of the accessory 190.

The accessory 190 includes a front attachment interface element 193 that forms an outer front portion or outer front wall of the accessory 190. The front attachment interface element 193 includes a front attachment interface portion 195 formed as an integral component of the front attachment interface element 193. In various exemplary embodiments, a plurality of accessory apertures 198 are formed through at least a portion of the front attachment interface portion 195 at spaced apart locations and arranged in one or more rows and/or columns, such that tunnel segments are formed between adjacent accessory apertures 198. In certain exemplary embodiments, as few as two accessory apertures 198 are included. It should be appreciated that the number, size, shape, and arrangement of any accessory apertures 198 is a design choice based upon the size and shape of the front attachment interface element 193 or portion of the front attachment interface element 193 that is desired to potentially accept attachment or coupling of additional accessories.

Each accessory aperture 198 is generally formed as an aperture or hole through the front attachment interface portion 195 of the front attachment interface element 193 of the accessory 190. However, in various exemplary embodiments, one or more accessory apertures 198 may be formed through the rear pouch panel.

The overall size of each accessory aperture 198 is also a design choice. In certain exemplary embodiments, the size of each accessory aperture 198 is influenced or dictated by the width of the accessory 190 coupling element of a compatible accessory 190.

In various exemplary embodiments, each accessory aperture 198 may optionally be formed of an elongate accessory aperture 198 formed through a portion of the outer accessory panel 197 or front wall of the accessory 190. Each accessory aperture 198 may be formed directly through the outer accessory panel 197 or front wall or formed in a front attachment interface element 193 attached or coupled to the outer accessory panel 197 of the accessory 190.

The accessory apertures 198 may be arranged in a repeating or semi-repeating series or sequence of spaced apart, repeating patterns. In various exemplary embodiments, the accessory apertures 198 are arranged in a repeating or semi-repeating series or sequence of spaced apart rows and columns 155. In various exemplary embodiments, the accessory apertures 198 are arranged in a series of equally spaced rows and equally spaced columns 155.

In certain exemplary embodiments, each of the rows is spaced at a distance that is the same as the spacing between each of the columns 155. Alternatively, the spacing between each of the rows is greater than or less than the spacing between each of the columns 155.

In various exemplary embodiments, the spacing between either edges or proximate centers of adjacent accessory apertures 198 (whether vertically, horizontally, obliquely, or diagonally adjacent) is influenced or dictated by the width of the accessory 190 webbing element of a compatible accessory 190.

It should be appreciated that two or more adjacent accessory apertures 198 may comprise a row and two or more adjacent accessory apertures 198 may comprise a column. Thus, it should be appreciated that the number of accessory apertures 198 is a design choice based upon the desired size and/or functionality of the front attachment interface element 193 and/or rear pouch panel.

In various exemplary, nonlimiting embodiments, each adjacent row and/or column of spaced apart accessory apertures 198 is offset such that either edges or proximate centers of adjacent accessory apertures 198 are offset by approximately ±45°, approximately ±33°, or approximately ±90°. If for example, either edges or proximate centers of adjacent accessory apertures 198 are offset by ±45°, ±33°, or ±90°, an attached or coupled compatible accessory 190 may be attached or coupled at least at ±0°, ±90°, ±33°, or ±45°. Thus, it should be appreciated that the offset of adjacent rows and/or columns dictates the angle of oblique attachment of accessories.

In certain exemplary, nonlimiting embodiments, each accessory aperture 198 may be separated from each other accessory aperture 198 by a distance that is equal to or greater than a width of each accessory aperture 198. Alternatively, each accessory aperture 198 may be separated from each other accessory aperture 198 by a distance that is equal to or greater than a width of each accessory aperture 198.

By arranging the accessory apertures 198 in a repeating or semi-repeating series or sequence, aperture array tunnel segments are created between adjacent accessory apertures 198 (whether vertically, horizontally, obliquely, acutely, or diagonally adjacent).

While the present disclosure has been described in conjunction with the exemplary embodiments outlined above, the foregoing description of exemplary embodiments of the present disclosure, as set forth above, are intended to be illustrative, not limiting and the fundamental disclosed systems, methods, and/or apparatuses should not be considered to be necessarily so constrained. It is evident that the present disclosure is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. An interlocking attachment system, comprising:

an interface portion, wherein a plurality of interface apertures are provided through at least a portion of said interface portion, wherein said interface apertures are aligned in at least one column, and wherein at least one locking aperture is provided through said interface portion, proximate a last of said aligned interface apertures, wherein said at least one locking aperture is defined by an opposing top wall and a bottom wall and a pair of opposing, substantially equal length, parallel side walls, and wherein an upturned corner portion is formed between said top wall and each of said parallel side walls; and at least one attachment element extending from a portion of said interface portion to a terminal end, wherein said interface portion and said at least one attachment element are formed as a unitary body, wherein attachment element notches are formed in opposing side portions of said at least one attachment element defining a neck portion of said attachment element, wherein said attachment element notches define barb portions that extend away from said terminal end of said attachment element, wherein at least a portion of said at least one attachment element is positionable through said at least one locking aperture such that said neck portion of said at least one attachment element is positionable within said locking aperture, and wherein if a withdrawing force is applied to said attachment element a portion of said barb portions engages a portion of at least one of said upturned corner portions.

2. The interlocking attachment system of claim 1, wherein a distance between said parallel side walls defines a width of said locking aperture.

3. The interlocking attachment system of claim 1, wherein a width of each locking aperture corresponds to a width of said neck of said attachment element between opposing attachment element notches of a given attachment element.

4. The interlocking attachment system of claim 1, wherein each locking aperture is generally formed as a rectangular or rounded rectangular slot or aperture.

5. The interlocking attachment system of claim 1, wherein each of said upturned corner portions extends away from said bottom wall.

6. The interlocking attachment system of claim 1, wherein each of said upturned corner portions extends beyond at least a portion of said top wall to an apex.

7. The interlocking attachment system of claim 1, wherein a flap portion is defined between said upturned corner portions.

8. The interlocking attachment system of claim 1, wherein said attachment element notches comprise mirror image recesses.

9. The interlocking attachment system of claim 1, wherein said neck portion has a reduced width, when compared to a width of other portions of said body portion.

10. The interlocking attachment system of claim 1, wherein a width of said barb portion is substantially similar to a width of said body portion of said attachment element.

11. The interlocking attachment system of claim 1, wherein said notch recess wall is formed substantially perpendicular to a longitudinal axis of said attachment element.

12. The interlocking attachment system of claim 1, wherein each of said attachment element notches is defined by a notch recess wall that extends into a portion of said body portion, a notch wall that extends from said notch recess wall to a notch apex, and a barb shoulder wall that extends from said notch apex to a barb apex.

13. The interlocking attachment system of claim 12, wherein each barb portion extends from said notch apex, along said barb shoulder wall, to said barb apex of each attachment element notch, away from said terminal end of said attachment element.

14. The interlocking attachment system of claim 12, wherein said barb shoulder wall is formed at an acute angle relative to a longitudinal axis of said attachment element.

15. The interlocking attachment system of claim 12, wherein said barb shoulder wall is formed at an obtuse angle relative to a longitudinal axis of said attachment element.

16. The interlocking attachment system of claim 1, wherein if a withdrawing force is applied to said attachment element a portion of said barb portions engages a portion of at least one of said upturned corner portions to resist said withdrawing force.

17. The interlocking attachment system of claim 1, wherein further comprising two or more attachment elements extending from said interface portion and a corresponding column of interface apertures and at least one locking aperture for each attachment element.

18. An interlocking attachment system, comprising:

an interface portion having at least one locking aperture formed therethrough, wherein said interface apertures are aligned in at least one column, and wherein at least one locking aperture is provided through said interface portion, proximate a last of said aligned interface apertures, wherein said at least one locking aperture is defined by a top wall and an opposing bottom wall and a pair of opposing, substantially equal length, parallel side walls, and wherein an upturned corner portion is defined between said top wall and each of said parallel side walls; and at least one attachment element extending from a portion of said interface portion to a terminal end, wherein said interface portion and said at least one attachment element are formed as a one-piece article, wherein attachment element notches are formed in opposing side portions of said at least one attachment element defining a neck portion of said attachment element, wherein said attachment element notches define barb portions that extend away from said terminal end of said attachment element to a barb apex, wherein at least a portion of said at least one attachment element is positionable through said at least one locking aperture such that said neck portion of said at least one attachment element is positionable within said locking aperture, and wherein if a withdrawing force is applied to said attachment element a portion of said barb portions engages a portion of at least one of said upturned corner portions to aid in resisting said withdrawing force.

19. The interlocking attachment system of claim 18, wherein each of said attachment element notches is defined by a notch recess wall that extends into a portion of said body portion, a notch wall that extends from said notch recess wall to a notch apex, and a barb shoulder wall that extends from said notch apex to said barb apex.

20. An interlocking attachment system, comprising:

an interface portion having at least one locking aperture formed therethrough, defined by a top wall and an opposing bottom wall and a pair of opposing, substantially equal length, parallel side walls, and wherein an upturned corner portion is defined between said top wall and each of said parallel side walls; and at least one attachment element extending from a portion of said interface portion to a terminal end, wherein attachment element notches are formed in opposing side portions of said at least one attachment element defining a neck portion of said attachment element, wherein said attachment element notches define barb portions that extend away from said terminal end of said attachment element to a barb apex, wherein at least a portion of said at least one attachment element is positionable through said at least one locking aperture such that said neck portion of said at least one attachment element is positionable within said locking aperture, and wherein if a withdrawing force is applied to said attachment element a portion of said barb portions engages a portion of at least one of said upturned corner portions to aid in resisting said withdrawing force.

* * * * *